United States Patent [19]

Fox et al.

[11] 4,360,333

[45] Nov. 23, 1982

[54] AGGREGATE EXPOSING MACHINE

[75] Inventors: Lonnie G. Fox, Bloomington; David W. Hanson, Golden Valley; Richard C. Nash, New Prague, all of Minn.

[73] Assignee: Fabcon, Incorporated, Savage, Minn.

[21] Appl. No.: 289,713

[22] Filed: Aug. 3, 1981

[51] Int. Cl.[3] ..... B28B 1/29

[52] U.S. Cl. ..... 425/299; 425/306

[58] Field of Search ..... 425/299, 306

[56] References Cited

U.S. PATENT DOCUMENTS 3,469,000 9/1969 Smith ..... 425/432

3,775,529 11/1973 Steenson ..... 264/162

*Primary Examiner*—John A. Parrish

*Attorney, Agent, or Firm*—Schroeder, Siegfried, Vidas, Steffey & Arrett

[57] ABSTRACT

A machine for removing uncured concrete from the top surface of a cast concrete slab to expose the aggregate therein to provide a decorative surface finish. The machine utilizes a pair of counter-rotating brushes to remove concrete which has been prevented from setting by use of a surface retarder, thereby exposing the aggregate to leave an attractive exposed aggregate finish. The counter-rotating brushes deposit the uncured concrete brushed from the surface of the slab onto a conveyor which carries the concrete waste to the edge of the slab for disposal.

6 Claims, 2 Drawing Figures

AGGREGATE EXPOSING MACHINE

BACKGROUND OF THE INVENTION

This invention relates to a machine used to form a decorative surface on a cast concrete panel.

A number of patents have appeared in the prior art dealing with methods for applying surface finishes to cast concrete panels. Some of those patents, such as Steenson U.S. Pat. No. 3,775,529, have dealt with the application of a raised ribbed finish having exposed aggregate appearing between the ribs. To provide such a finish, Steenson utilized a plurality of rotating discs on a common hub to form the ribs and thereby removing part of the top surface layer of the concrete to expose the aggregate between the ribs by lifting the excess concrete from the face of the panel.

The structure shown in Steenson et al does not lend itself to uniformly exposing the aggregate over the entire surface of the cast panel.

SUMMARY OF THE INVENTION

In accordance with the invention, there is provided a machine for exposing the aggregate on the surface of a cast concrete panel utilizing two counter-rotating cylindrical brushes. A material conveyor is provided to receive the concrete removed from the surface of the panel by the counter-rotating brushes to convey the waste concrete to the side of the panel for disposal. Water jets are used to moisten the surface of the panel before the brushes engage it and to provide a final cleaning of the exposed aggregate after the brushes have exposed the surface.

The machine exposes the aggregate in a cast concrete panel in a repeatable, uniform and rapid manner to form an attractive surface finish.

DETAILED DESCRIPTION OF THE INVENTION

Figure 1:
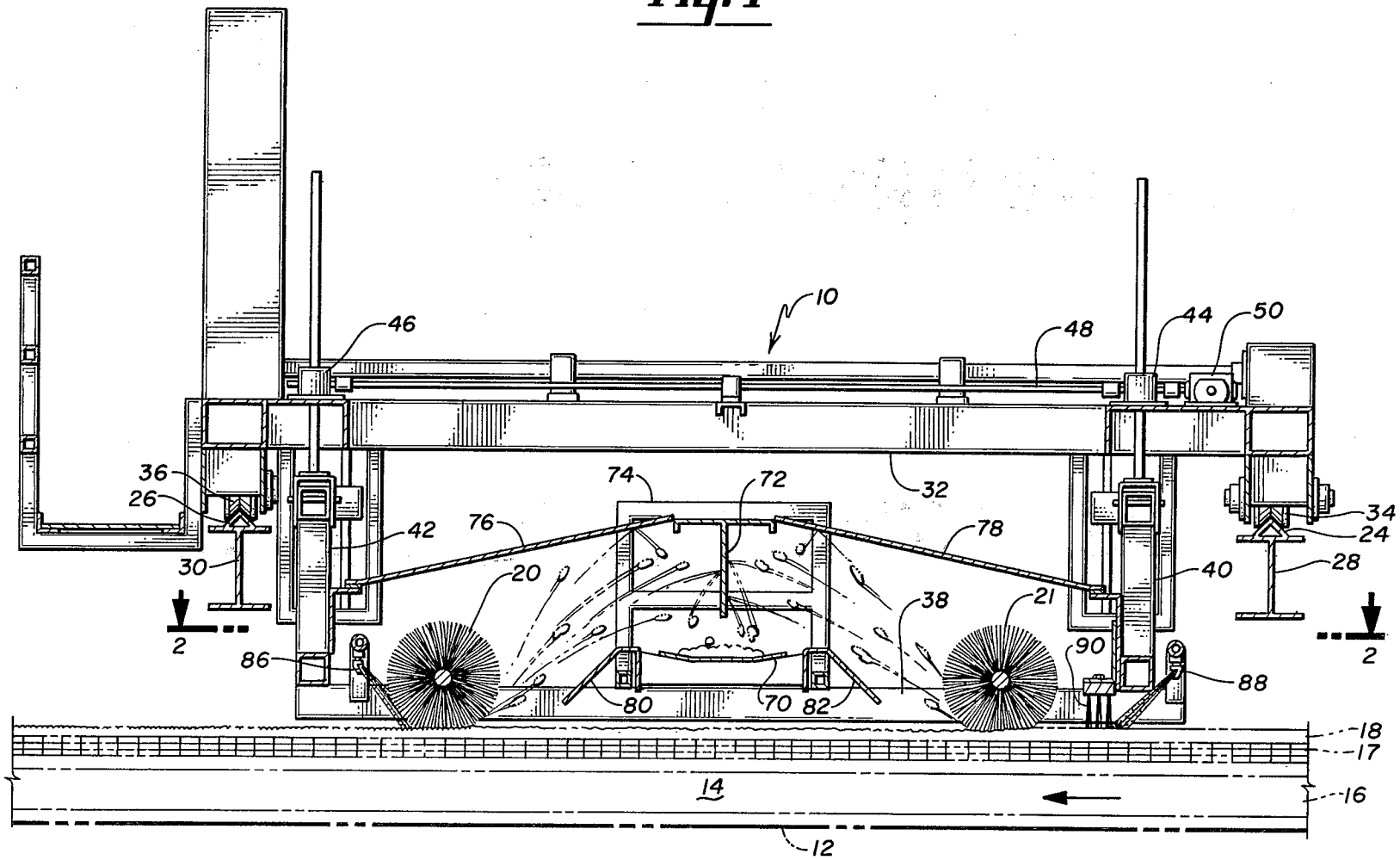
FIG. 1 is a side elevation view of the machine with parts cut away and the concrete slab and the concrete removed from the surface of the slab as shown in phantom outline.

In FIG. 1, there is shown a side elevation view of the machine 10. The machine is positioned above a concrete casting pallet 12 upon which a concrete cast panel has been previously cast. A suitable casting machine which may be used for casting such a concrete panel is shown in co-pending application Ser. No. 257,781, filed Apr. 27, 1981, entitled Machine for Casting Concrete Members, assigned to the assignee of the present invention.

Figure 2:
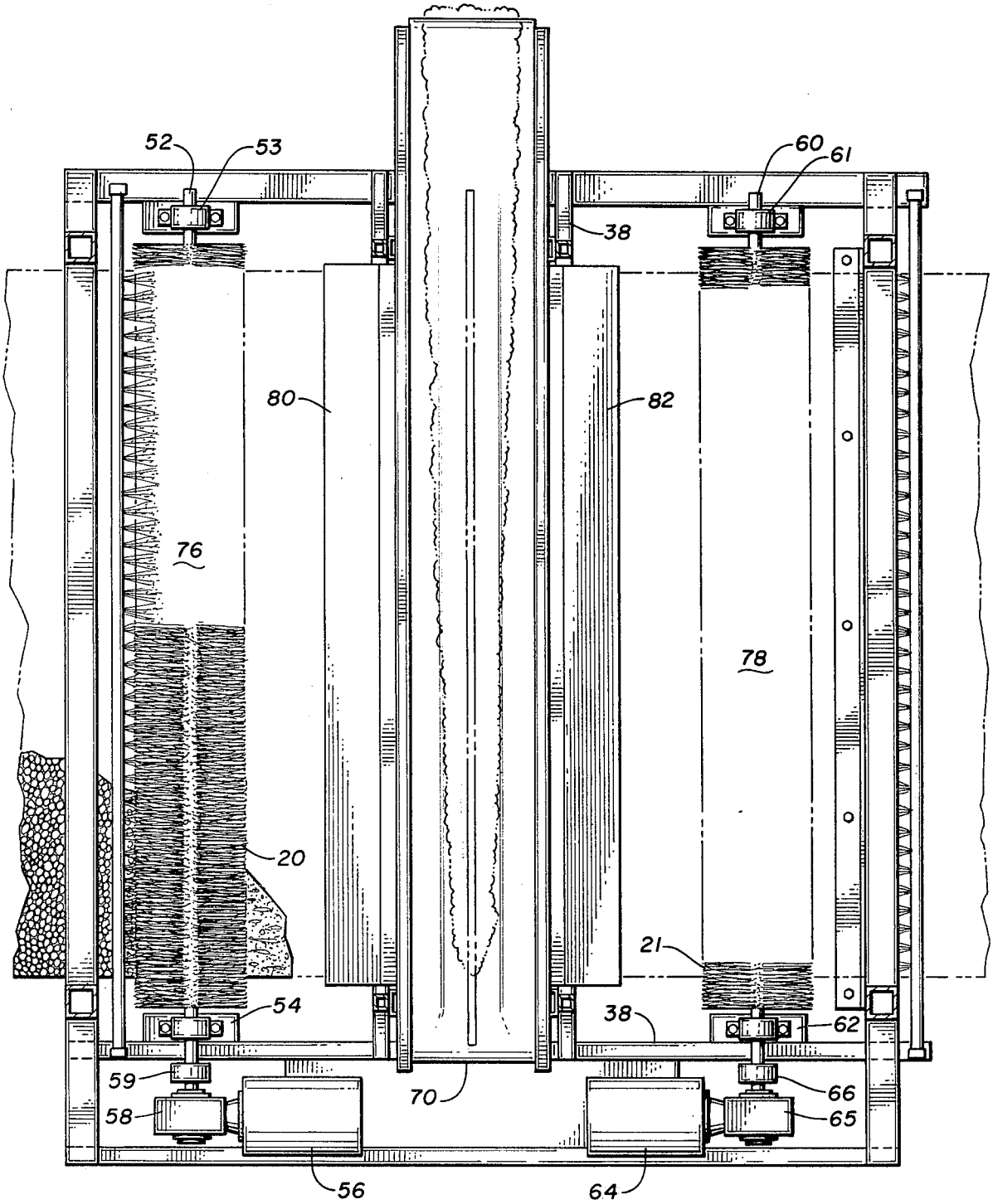
FIG. 2 is a sectional top plan view of the machine taken along line 2—2 of FIG. 1.

Although the preferred embodiment of the invention, shown in FIGS. 1 and 2, is illustrated for use in a procedure in which the concrete panel is cast on a movable casting bed by a casting machine which remains stationary and in which the aggregate exposing machine 10 also remains stationary during its operation on the top surface of the concrete plank, it will be appreciated by those skilled in the art that the present invention can also be adapted to be moved by conventional means along a concrete panel resting upon a stationary casting pallet.

In the side view of the machine shown in FIG. 1, the side of the casting pallet has been removed to expose the edge of the panel 14, and the concrete plank is shown in phantom outline only. The panel is a sandwich panel comprised of a bottom concrete layer 16, an insulating layer 17 and an upper layer 18. A method for manufacturing such a structure is disclosed, for example, in co-pending application Ser. No. 239,330, filed Mar. 2, 1981, and assigned to the assignee of the present invention.

When it is desired to manufacture concrete panels having an exposed aggregate finish, it is necessary to apply a suitable retarder, such as those manufactured by Preco, Inc., Plainview, N.Y., to the top layer 18 of concrete before the concrete panel is cured. After the surface of the concrete panel has been cured for by conventional means, such as the application of a controlled amount of heat to accelerate the normal concrete curing process, the extreme top layer of concrete is then removed by the aggregate exposing machine utilizing a pair of counter-rotating cylindrical brushes 20 and 21. The brushes have polypropylene double wrapped bristles from Shaeffer Brush Co. of Milwaukee, Wis.

The aggregate exposing machine is moved over the movable casting bed 12 on transverse rails 24 and 26, which are supported, respectively, on I beams 28 and 30, which are suspended above the casting bed 12 from suitable footings or support means, not separately shown herein. The frame 32 of the aggregate exposing machine has flanged wheels 34 and 36 which allow the aggregate exposing machine 10 to be moved along rails 24 and 26 to position the aggregate exposing machine above the casting bed 12 when it is desired to manufacture exposed aggregate panels and to move the machine to adjacent parallel casting beds or a machinery storage area when the use of the aggregate exposing machine is not desired.

Brushes 20 and 21 are mounted for rotation on a frame 38 which is suspended from the upper frame 32 by vertical supports 40 and 42. The height of the lower frame 38 and hence of brushes 20 and 21 above the casting bed 12 can be varied by raising and lowering the vertical members 40 and 42. Those members are connected to jack screws 44 and 46, respectively, which are, in turn, operated by a shaft 48 which is driven by a motor 50.

As is best seen in FIG. 2, brush 20 is mounted on a shaft 52 which is, in turn, mounted for rotation in pillow block bearings 53 and 54. The drive for shaft 52 is provided by motor 56 through a gear reducer 58 and a coupler 59. Similarly, brush 21 is mounted on a shaft 60 supported by pillow block bearings 61 and 62 which is driven by a motor 64 through a gear reducer 65 and a coupler 66.

In order to provide a uniform and attractive exposed aggregate facing on the panel, it is necessary that the concrete surface treated with retarding agent is removed totally from the surface of the panel, leaving the aggregate below the surface in place and uniformly exposed. This is accomplished by the deflector and conveyor structures shown in FIGS. 1 and 2. Concrete removed by brushes 20 and 21 is thrown or directed upwardly from the surface of the panel 14 and onto the surface of a continuous conveyor belt 70. In the preferred embodiment shown, the conveyor belt is a Chatland self-powered car unloader and has an overall length of about 11 feet, several feet more than the nominal 8-foot width of the concrete panel being treated.

In order to prevent the concrete material removed from the plank by brushes 20 and 21 from being thrown beyond the conveyor 70, a spatter board 72 is suspended from a frame 74 which is, in turn, suspended from the lower frame 38. In addition to the spatter board 72, individual deflector sheets 76 and 78 are provided to cover the brushes 20 and 21 and assure that concrete thrown by the brushes is directed to the spatter board and onto the conveyor 70. Additional deflectors 80 and 82 are also suspended from frame 74 and directed downwardly toward the surface of the panel 14 to deflect thrown concrete fragments which impinge upon the deflectors upwardly onto conveyor 70.

Conveyor 70 is driven to transport concrete deposited on its surface to the side of the bed where the waste concrete can be deposited into a waste gutter or onto any other conveying means for removal.

In addition to the brushes, the surface of the retarded set concrete is removed from the panel by use of water nozzles 86 and 88, as shown. In normal operation of the aggregate material exposing machine, there is relative movement occuring between the plank and the machine with the plank moving left relative to the frame of the exposing machine.

In addition to the two rotary brushes 20 and 21 and the two water spraying nozzles 86 and 88, a fixed brush 90 depending from the frame is utilized after the spray bar 88 to loosen the concrete from the surface of the panel before the surface is engaged by the first rotary brush 21. To assure adequate coverage of the water from nozzles 86 and 88 to the surface of the concrete panel, the nozzles are mounted on six-inch centers to cover the entire width of the panel. The fixed brush 90 may also be described as a steel broom mounted on the frame member with slotted holes to provide for relatively simple vertical adjustment of the tip of the broom to provide for wear of the brush 90.

What is claimed is:

1. A machine for forming an exposed aggregate finish on a cured precast concrete panel, the surface of which has been treated with a retarding agent to retard the curing thereof, said machine comprising, in combination:

a frame;

means for introducing relative motion between said frame and the surface of said panel;

first rotary brushing means mounted on said frame for rotation about an axis parallel to the surface of said panel and perpendicular to the axis of relative movement between said frame and the panel, said brushing means constructed and arranged to abrade and remove the uncured retarded concrete surface to leave an exposed aggregate surface; and conveying means mounted on said frame, said conveying means constructed and arranged for receiving uncured concrete material removed from the surface of said plank by said first rotary brushing means and for conveying the concrete away from the concrete panel.

2. The machine of claim 1, also including second rotary brushing means mounted on said frame for rotation about an axis parallel to the surface of said panel and perpendicular to said frame and the panel, said second rotary brushing means constructed and arranged to abrade and remove that portion of the uncured concrete surface of said panel which was not removed by said first rotary brushing means, said second rotary brushing means located on the opposite side of said conveying means from said firt rotary brushing means.

3. The invention of claim 1, wherein deflection means channel the concrete removed by said first rotary brushing means for depositing the concrete on said first conveying means.

4. The invention of claim 2, wherein deflection means are included for directing concrete removed by said first and second brush means to said conveying means.

5. The invention of claim 1, wherein nozzle means are provided for prewetting the uncured upper surface of the concrete panel prior to the surface being contacted by said first rotary brushing means.

6. The invention of claim 1, wherein stationary brushing means are provided for abrading the uncured concrete surface of the panel prior to the surface being engaged by said first rotary brushing means.

* * * * *